US005666813A

United States Patent [19]

Brune

[11] Patent Number: 5,666,813

[45] Date of Patent: Sep. 16, 1997

[54] AIR CONDITIONING SYSTEM WITH REHEATER

[76] Inventor: Paul C. Brune, 311 Greenbay Ct., NE., Palm Bay, Fla. 32907

[21] Appl. No.: 254,488

[22] Filed: Jun. 6, 1994

Related U.S. Application Data

[63] Continuation of Ser. No. 977,556, Nov. 17, 1992, abandoned.

[51] Int. Cl.[6] ..... F25D 17/06; F25B 1/00

[52] U.S. Cl. ..... 62/90; 62/510

[58] Field of Search ..... 236/44 C; 62/90, 62/173, 176.5, 510

[56] References Cited

U.S. PATENT DOCUMENTS

| | | | |
|---|---|---|---|
| 2,155,484 | 4/1939 | Gottlieb | 62/510 X |
| 2,204,394 | 6/1940 | Bailey | 62/510 X |
| 2,241,060 | 5/1941 | Gibson | 62/510 |
| 2,286,605 | 6/1942 | Crawford | 62/90 X |
| 3,402,564 | 9/1968 | Nussbaum | 62/90 X |
| 4,270,362 | 6/1981 | Lancia et al. | 62/173 |

*Primary Examiner*—William E. Wayne

[57] ABSTRACT

Apparatus to condition air comprising a blower to effect a flow of air to be conditioned in a path of travel from a first location to a second location; a cooling member along the path of travel adjacent to the first location adapted to initially cool the air flowing therepast, the cooling means having, in association therewith, pipes for circulating a cooling fluid between the cooling member whereat thermal energy is added to the cooling fluid and a location outside the path of travel whereat thermal energy is removed from the first cooling fluid; a condenser along the path of travel adjacent to the second location adapted to reheat the air flowing therepast; an evaporator within the path of travel between the cooling member means and the condenser adapted to further cool the air flowing therepast; a compressor; piping coupling the evaporator, condenser and compressor for circulating cooling fluid therebetween.

2 Claims, 5 Drawing Sheets

FIG 1
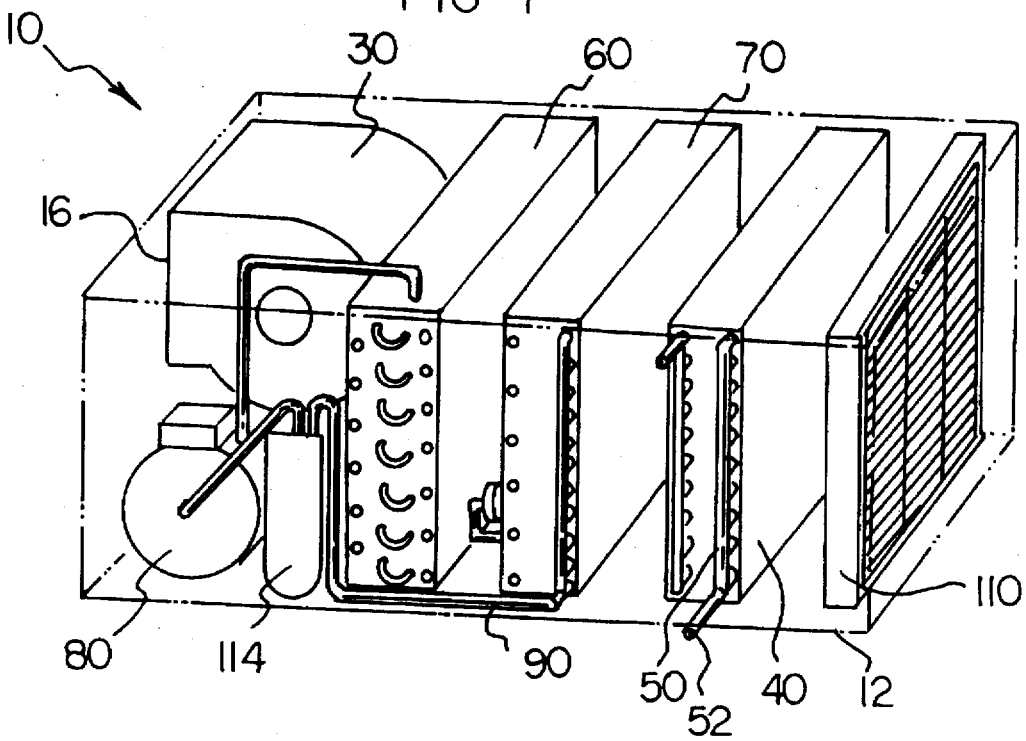
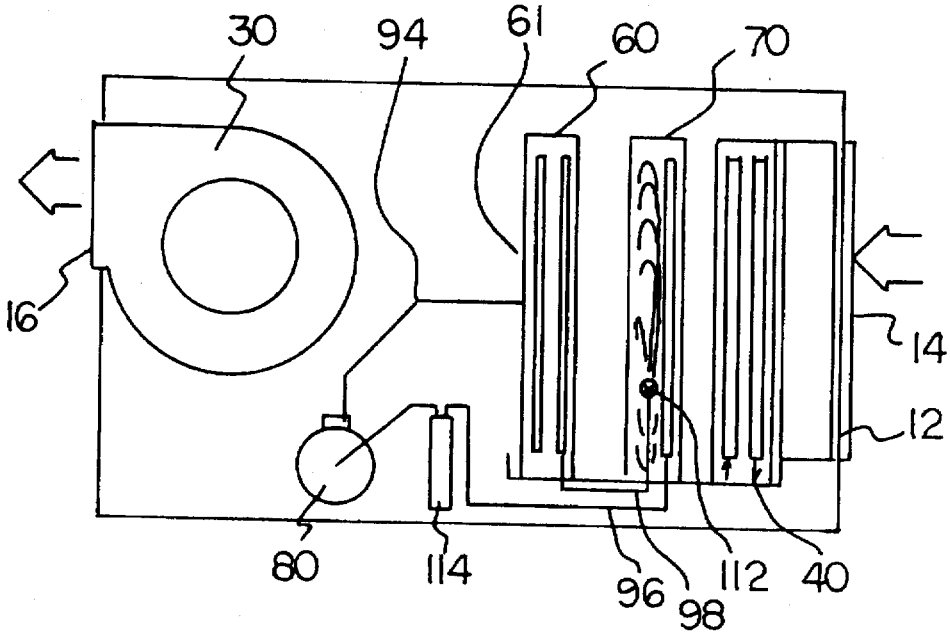
FIG 2

AIR CONDITIONING SYSTEM WITH REHEATER

This is a continuation of patent application Ser. No. 07/977,556, filed on Nov. 17, 1992, now abandoned.

BACKGROUND OF THE INVENTION

1. Field of the Invention

This invention relates to air conditioning systems with reheaters and, in particular, to air conditioning systems with a first and second cooler and a reheater following the second cooler.

2. Description of the Background Art

The invention of air conditioning by Dr. Willis Carrier more than 75 years ago was brought about due to unacceptable moisture levels in the air. The problem plagues us yet today considering indoor air quality or any application where humidity control is required or desired. Since the original air conditioner, it has been known that air conditioning involves the reduction of temperature (sensible heat) and also the reduction of humidity levels (latent heat). The total heat contained in space is the sum of the sensible heat (as indicated by dry bulb temperatures) and latent heat, indicated by wet bulb temperatures which refers to the moisture content in the air.

It is well known that when air is passed through a cooling coil or some other type of cooling device, both temperature and humidity may be reduced. Temperature can be reduced by removing heat from the air and part of the super-heat of the water vapor contained therein. To reduce humidity, it is necessary to condense a part of the water vapor contained in the air. This requires removing heat from the air until the dew point temperature is reached, and then removing further heat to cause condensation of the water vapor. A cooling device thus first acts primarily to remove sensible heat until the dew point temperature has been reached, and then acts to remove the latent heat of the water vapor in the air, condensing the water vapor, resulting in dehumidification.

The operation of a conventional refrigeration system is well understood. A compressor acts to remove vaporized refrigerant from a cooling coil and to increase the pressure on such refrigerant. The compressed refrigerant then passes into a condenser where heat is removed therefrom, causing liquefication of the compressed refrigerant. The liquefied refrigerant is then passed through a metering device wherein the pressure upon it is reduced. Upon entry of the liquid refrigerant into a cooling coil, the refrigerant changes its state from a liquid to a vapor, this action causes a lowering in temperature of the cooling coil and facilitates the absorption of heat by the refrigerant and coil. The vaporized refrigerant is then drawn into the suction side of the compressor and the cycle is repeated. For automatic temperature regulation, a thermostatic expansion valve may be provided having its thermostatic bulb located at the outlet of the evaporating coil. This arrangement acts to admit sufficient refrigerant into the cooling coil to keep such coil substantially full of liquid refrigerant.

In a conventional cooling device, assuming that the heat removal capacity of the cooling device remains fairly constant and that the dew point temperature of the air is likewise fairly constant, the amount of dehumidification caused by such a cooling device will depend upon the temperature of the entering air. For instance, if the temperature of the entering air is at the dew point, substantially all of the heat removal capacity of the cooling device will go towards removal of water vapor. If, however, the temperature of the entering air is substantially above the dew point, the coil must first act to remove sensible heat until the dew point temperature has been reached before condensation of water vapor will begin. The amount of condensation will therefore be considerably less. It follows that by varying the temperature of the air entering the cooling device, the dehumidifying action of such device may be controlled. It also follows from the above, that the reduction of the humidity of the air to a low level will require that the air be cooled to a low temperature. If the temperature of the air is too low, it would be too cold for direct supply to a space to be air conditioned, i.e., it would overcool the space.

The present invention is directed to improving air conditioning systems in a manner which is safe, secure and economical.

It is known to take advantage of thermodynamic principles to adjust for the above problem. U.S. Pat. No. 2,200,118 to Miller teaches pre-cooling, cooling and reheating by a single refrigeration system. An auxiliary evaporator is placed in the conditioning chamber in advance of the main cooling coil, and a condenser associated with the auxiliary evaporator is placed on the down-stream side of such main cooling coil to act as a reheater. A liquid refrigerant is passed through an expansion valve into the auxiliary evaporator wherein part of the refrigerant is evaporated, thereby causing pre-cooling of the air. The mixture of liquid and gaseous refrigerant is then passed into the reheater wherein the vaporized refrigerant is condensed giving off the heat of condensation for reheating the air. The liquid refrigerant from the reheater, which has given off heat and is thus cooled, is subsequently passed into the main cooling coil wherein it is evaporated, thereby causing cooling of the air. It is apparent that the sensible heat from the air upstream of the main cooling coil is being used to reheat the air.

An air conditioning apparatus capable of dehumidifying air with substantially no reduction in dry bulb temperature when conditions require such a treatment is disclosed in U.S. Pat. 2,093,725 to Hull. The invention involves transferring heat from air to be conditioned to a fluid (or secondary refrigerant). The air is then further cooled by an independent instrumentality, at which point condensation and humidification occur. Finally, the heat which has been transferred to the fluid is transferred from the fluid (or from a condenser of the secondary fluid) to the air to reheat the cooled air as desired. By this procedure, sensible heat of the air above the dew point is transferred to the fluid in a first cooling stage and then returned to the air in the reheating stage. The primary refrigerant compressor and condenser do not contact the air to be conditioned.

U.S. Pat. No. 2,286,605 to Crawford teaches an air conditioning system having a first cooling stage primarily for reduction of sensible heat, a second cooling stage primarily for reduction in of latent heat, and a reheating stage to add sensible heat back to the air. The cooling fluid used in the system is water. The invention is directed in part to a novel cooling tower. Water cooled in first and second evaporators is sent to first and second cooling coils for cooling the air. Water vapor removed from the evaporators is compressed in centrifugal compressors and condensed in condensers. Relatively cool water leaving the reheater is used to condense vapor from the evaporator for the second cooling stage. Relatively warmer water from the cooling tower is used to condense vapor from the evaporator for the first cooling stage. The giving off of sensible heat which results in the cooling of the water in the reheater is thus used to aid in cooling the water vapor withdrawn from the second stage evaporator. The reheating stage assists in the cooling action performed in the latent cooling stage. Steam is discharged from steam turbines to drive compressors. Further, heated water from the evaporators is sent to a cooling tower. Subsequently, some of the water inside the cooling tower is sent through the reheater. The amount of sensible heat added by the reheater is substantially equivalent to the latent heat removed in the second cooling stage.

A method and apparatus for cooling and drying air to a very low level of humidity by cooling the air to twenty degrees Fahrenheit is disclosed in U.S. Pat. No. 3,119,239 to Sylvan. Sylvan teaches a method and apparatus by which cooling can be obtained without the expected problem of coil frosting. Air to be conditioned is first passed through an upstream cooling coil having a surface temperature slightly above freezing. A substantial quantity of the moisture in the air is removed therefrom by condensation in liquid form upon the surfaces of the upstream cooling coil. Thereafter, a sufficient quantity of air at a temperature substantially below freezing obtained from downstream of the downstream cooling coil is mixed with the precooled and dehumidified air so that the temperature of the combined air is below freezing resulting in part of the moisture forming snow and frost particles without physically contacting the heat exchanger surface. This cooled air containing snow and frost particles is then passed through a downstream cooling coil having a surface temperature well below freezing to further cool the air whereby the frost and snow are separated from the air stream. The two cooling coils are in a single loop with a single compressor, the differences in temperature between the first and second cooling coils is attributable to differences in pressures. Hot gaseous refrigerant is provided from the compressor discharge to a reheat coil. The process and apparatus of Sylvan thus concern a first condensation step and a second freezing step, with no provision for a step of reducing only sensible heat.

Finally, U.S. Pat. No. 3,402,564 to Nussbaum et al discloses an air conditioning apparatus for two-stage cooling and dehumidification, wherein gaseous refrigerant from the compressor is used in reheating conditioned air. Instead of being returned to the compressor, refrigerant leaving the reheater is fed directly to a pair of evaporators.

As illustrated by the background art, efforts are continuously being made in an attempt to improve air conditioning systems. No prior effort, however, provides the benefits attendant with the present invention. Additionally, the prior patents and commercial techniques do not suggest the present inventive combination of component elements arranged and configured as disclosed and claimed herein.

The present invention differs from the above air conditioning systems in that, in the present invention, it is the latent heat which is used to reheat the air. This is particularly advantageous since the amount of reheating after dehumidification is a function of the amount the air is cooled below the dew point, which in turn is a function of the humidity present in the air and the amount of humidity to be removed from the air, and not a function of the sensible heat in the air to be conditioned.

The present invention achieves its intended purposes, objects, and advantages through a new, useful and unobvious combination of component elements, with the use of a minimum number of functioning parts, at a reasonable cost to manufacture, and employing only readily available materials.

Therefore, it is an object of this invention to provide an apparatus to condition air by lowering its temperature and by reducing its moisture content comprising a conduit having an input end for receiving air to be conditioned and an output end for dispensing condition air; blower means to effect a flow of air to be conditioned from the input end to the output end of the conduit; a cooling member within the conduit adjacent to the input end adapted to initially cool the air flowing therepast to a temperature near saturation, the cooling member having, in association therewith, pipes in a closed first loop with means for circulating a first cooling fluid between the cooling member whereat thermal energy is added to the first cooling fluid and a remote location whereat thermal energy is removed from the first cooling fluid; a condenser within the conduit adjacent to the output end adapted to reheat the air flowing therepast; an evaporator within the conduit between the cooling member and the condenser adapted to further cool the air flowing therepast to lower dew point for temperature reduction and moisture content reduction; a compressor; piping coupling the evaporator, condenser and compressor in a closed second loop, independent of the closed first loop, for circulating a second cooling fluid between (a) the evaporator whereat thermal energy is added to the second cooling fluid, (b) the condenser whereat thermal energy is removed from the second cooling fluid, and (c) the compressor whereat the cooling fluid is compressed.

Another object of the present invention to more efficiently condition air.

It is a further object of the present invention to provide a preliminary and secondary cooling of air to be conditioned followed by a reheating of the conditioned air.

It is a further object of the present invention to couple a second cooling component of an air conditioning system with a reheater.

The foregoing has outlined some of the more pertinent objects of the invention. These objects should be construed as merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an apparatus to condition air by lowering its temperature and reducing its moisture content. The apparatus comprises a conduit having an input end for receiving air to be conditioned and an output end for dispensing conditioned air. A blower means effects a flow of air to be conditioned from the input end to the output end of the conduit. Further, a cooling member within the conduit adjacent to the input end is adapted to initially cool the air flowing therepast to a temperature near saturation. The cooling member has, in association therewith, pipes in a closed first loop with means for circulating a first cooling fluid between the cooling member whereat thermal energy is added to the first cooling fluid and a remote location whereat thermal energy is removed from the first cooling fluid. Additionally a condenser within the conduit adjacent to the output end is adapted to reheat the air flowing therepast. An evaporator within the conduit between the cooling member and the condenser further cools the air flowing therepast to lower dew point for temperature reduction and moisture content reduction. The apparatus further includes a compressor and piping coupling the evaporator, condenser and compressor in a closed second loop, independent of the closed first loop, for circulating a second cooling fluid between the evaporator whereat thermal energy is added to the second cooling fluid, the condenser whereat thermal energy is removed from the second cooling fluid, and the compressor whereat the cooling fluid is compressed.

The present invention may also be incorporated into an apparatus to cool air having means to effect a flow of air to be conditioned in a path of travel from a first location in communication with a room to a second location in communication with the room.

The present invention may also be incorporated into an apparatus to cool air having means to effect a flow of air to be conditioned in a path of travel from a first location in communication with the room and ambient air or with ambient air only.

The foregoing has outlined rather broadly the more pertinent and important features of the present invention in order that the detailed description of the invention that follows may better be understood so that the present contribution to the art can be more fully appreciated. Additional features of the invention will be described hereinafter which will form the subject matter of the claims of the invention. It should be appreciated by those skilled in the art that the conception nd the disclosed specific structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be had to the following detailed description taken in conjunction with the accompanying drawings in which:

FIG. 1 is a perspective view of the air conditioning system constructed in accordance with the principles of the present invention.

FIG. 2 is a side schematic illustration of the air conditioning system constructed in accordance with the principles of the present invention.

Similar reference characters refer to similar parts throughout the several figures.

DETAILED DISCUSSION OF THE INVENTION

Overview

Figure 3:
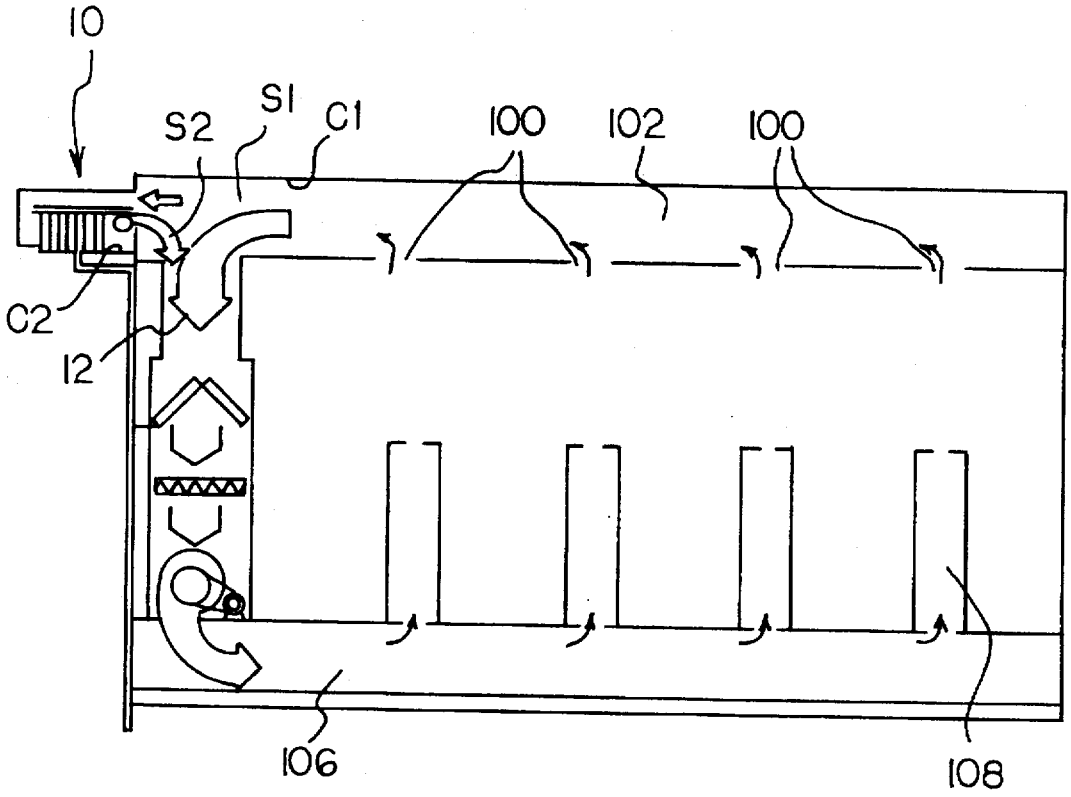
FIG. 3 is a plan view of the air conditioning system showing the circulation paths of air to be cooled and subsequent distribution of the cooled air.

Shown in FIGS. 1 through 6A are various views of the apparatus 10 to condition air and reduce the moisture content in the air. The apparatus has a conduit 12 having a first input end 14 for receiving the air to be conditioned. The input end may receive air from a location 20 from within a room to be conditioned, a location 22 from within the room to be conditioned and from an ambient air location or only from an ambient air location 24. Additionally the conduit has an output end 16 for dispensing the conditioned air to the room. The apparatus further includes blower means 30 for effecting air flow from the input end to the output end of the conduit. Furthermore, a cooling means or member 40 positioned within the conduit adjacent to the input end and is adapted to initially cool air flowing therepast to a temperature near saturation. In association with the cooling member are pipes 50 in a closed first loop 52. Means, not shown, are provided for circulating a first cooling fluid between the cooling member whereat thermal energy is added to the first cooling fluid and a remote location, not shown, whereat thermal energy is removed from the first cooling fluid.

Furthermore, the apparatus comprises a reheat means or condenser 60 within the conduit adjacent to the output end. The condenser is adapted to reheat the air flowing therepast. Additionally, an evaporator 70 is positioned within the conduit. The evaporator is positioned between the cooling member and the condenser. The evaporator is adapted to further cool air flowing therepast to lower dew point or temperature reduction and moisture content reduction. Finally a compressor 80 is further included in the apparatus. Coupling means or piping 94, 96 and 98 couples the evaporator 70, condenser 60 and compressor 80 in a closed second loop The second loop also contains a conventional pressure regulator 114. The closed second loop is independent of the closed first loop. The piping circulates a second cooling fluid between the evaporator whereat thermal energy is added to the second cooling fluid and the condenser whereat thermal energy is removed from the second cooling fluid. Finally, the piping circulates the second cooling fluid to the compressor whereat the cooling fluid is compressed.

The Preferred Embodiment

Whenever the space temperature is above a predetermined minimum value, such for instance as 70 degrees Fahrenheit, a room thermostat, not shown, causes operation of a compressor motor, not shown, and hence chilling of a cooling member or means 40. A fan or blower means 30 draws air through a return, a conduit or register 100 and duct 102 into a conditioning chamber 12 and across the cooling member, wherein its temperature is reduced. When no dehumidification is needed, the cooled air is discharged through the discharge duct 106 and register 108 back into the conditioned space. See FIG. 3. In FIG. 3, arrow S1 shows the first stream of air, part of a conventional air conditioning system to be pretreated with dehumidified air as it moves through conduit C1. Arrow S2 shows the second air stream feeding the dehumidified air through the second conduit C2 to the first stream. The output of the second stream is fed to the first stream and to the space.

As shown in FIGS. 1 and 2, the air passing through the cooling member 40 is first reduced in temperature, preferably until near the dew point. A second cooling member or means 70 has a surface temperature in the range of about 35–37 degrees F., and the air passing over the second cooling member is further reduced in temperature and the latent heat of evaporation of the water vapor contained in such air is removed, thereby causing a dehumidifying action as well as a further cooling action. This cooling and dehumidifying action continues until the space temperature and/or humidity is lowered to the predetermined level, at which time the thermostat may act to place the fan 30, compressor (s) 80, and cooling members 40 and 70 out of operation. As shown in the phycometric charges of FIGS. 4A, 5A and 6A, the air is cooled to between about 37 degrees fahrenheit and about 46 degrees fahrenheit.

A reheater or reheat means 60 is located in the path of the air which has been cooled by the second cooling member 70 and is therefore exposed to air of substantially lower temperature than that contacting the first cooling member 40 as shown in FIG. 1. Due to the relatively higher temperature to which the first cooling member is subjected, the liquid refrigerant therein is evaporated and absorbs heat from the air. The vapor then passes through a pipe 50 to the compressor, not shown. Compressed fluid from compressor 80 flows into the reheater 60. As the reheater is subjected to air of lower temperature, heat is removed from vaporized refrigerant, thereby causing it to condense and give up to the cooled air the same amount of heat that it absorbed from the incoming air. This occurs at a location 61 adjacent to reheater 60, a location whereat thermal energy is removed from the first fluid coolant. This liquid refrigerant then flows through the pipe 98 back to the cooling member 70 where it is re-evaporated and this cycle will be repeated continuously.

The reheater 60 is located downstream of the cooling member. A pipe means 94 going from the compressor to the reheater contain the compressed evaporated refrigerant, while the pipe means 98 going from the reheater to the evaporator contain refrigerant in a liquid state. A thermosyphonic circulation of refrigerant through the refrigerating system formed of the cooling member and reheater takes place. It should be apparent, that the main dehumidification/refrigeration and reheating system acts to remove heat from the air passing from the cooling member so that condensation and dehumidification take place, and subsequently act, in reheating, to give up as sensible heat the same amount of mainly latent heat which has been removed from the air by the second cooling member, this thermodynamic relationship is balanced.

A significant use of the invention 10 is in correction of the "sick building syndrome" which is due to insufficient dehumidification and a lack of proper fresh air resulting in terrible odors inside the building and possible airborne toxins. By way of example, an apparatus according to the present invention for air conditioning an 80,000 square foot two-floor building having eight air handlers, four on each floor, and a 7,000 cfm 100% outside air system running a two-step dehumidifier reduces the air flow to a 37-degree Fahrenheit dew point and back up to 75 degrees Fahrenheit. This results in supplying each air handler with adequate fresh dry air at room temperature which was dry enough not only to achieve the moisture level inside the building, but also at a low dew point, about 37 degrees Fahrenheit, which is enough to absorb the entire internal latent gain of the building and completely relieve the basic air conditioning system of all latent requirements. The air handlers of a conventional air conditioning system are incapable of reducing the room dew point to the desired level at full load and design coolant temperatures and fresh air dampers closed in a building such as this. At part load for a conventional air conditioning system, the leaving air temperature is above 60 degrees Fahrenheit and moisture levels are above 70% relative humidity. By incorporating the two-step dehumidification machine as described, low humidities can be maintained regardless of the sensible load, down to zero, and cost of operation is reduced due to higher coolant temperatures to the main cooler and provide adequate fresh air in the process.

Another application of this technology is in a computer room having very little latent removal to be addressed, however, if it is not removed, the moisture level in the room rises and reaches unsatisfactory humidity levels. The conventional computer room air conditioning system, when called upon for dehumidification, goes to full cooling and reheat added to prevent overcooling. Typical computer rooms operate at 72 degrees Fahrenheit room temperature with 65 degrees Fahrenheit supply air temperature at 50% relative humidity (60% absolute maximum). This condition demands above normal air flow resulting in oversized air conditioning systems with redundancy. On a call for dehumidification, these units go to full cooling in an effort to reach the required 46 degrees Fahrenheit dew point, then reheat to 65 degrees Fahrenheit to prevent overcooling and higher relative humidity. In many cases, the required low dew point is unachievable and humidity set point cannot be reached thereby locking the air conditioning system in a mode of full cooling and reheat resulting in enormous energy consumption.

The present invention, utilizes a small 1000 c.f.m. two-step dehumidifier and peels off 3% of return air, taking that air down to 35 degrees Fahrenheit dew point and right back to near 72 degrees Fahrenheit will remove 17 pounds of moisture per hour, enough to absorb the moisture gain of 20 people operating ⅓ of the time. This arrangement achieves the desired humidity level, relieves the main air conditioning system of all latent requirements thereby allowing higher coolant temperatures eliminating reheat and obtaining desired results at enormous energy savings.

There are many applications of this technology utilizing a mixture of the previous applications of all outside air or all inside air. For example, a cleanroom with varying amounts of make-up air to maintain positive pressure, low internal latent gain in addition to fresh air, smaller amounts of fresh air required with normal internal latent gain, or any application where humidity control is required or desired with various degrees of outside air.

A conventional arrangement controls a mixture of air to a two-step dehumidifier through a set of modulating dampers to vary the mixture of outside and return air. However this arrangement produces a large variation of load to the main cooling coil, although load on the second step evaporator condenser and compressor remains rather constant, and thereby forms a triangle on a psychrometric chart, not shown. The starting point of this triangle is the leaving air temperature off the main cooling coil. The next point is the leaving air temperature off the second step evaporator and the third point being the same enthalpy (wet bulb) as the starting point, the dew point of the second point plus a relative few degrees, representing the heat of compression, is called the tail of the triangle. By controlling the starting point (main cooling coil L.A.T.), the triangle will follow up and down raising or lowering the dew point (moisture level) of the second step evaporator L.A.T. A room pressurestat for controlling the return air and outside air dampers, and a room humidistat for controlling a modulating valve or capacity control of the main cooling coil provides for absolute stability of pressure and humidity inside the room. Room dry bulb temperature is controlled by downstream coil to handle the room sensible heat only.

In the preferred embodiment as shown in FIG. 2, an air filter 110 is adapted to receive the incoming air. This is followed by a cooling coil 40, a second-step evaporator 70, a second-step condenser 60, an accumulator 112, a pressure regulator 114, a compressor 80 and blower 30. The spaces along the path of travel of air to be conditioned include the incoming air which is all outside air (AOA), all inside air (ARA), or a mixture thereof (AMIX). The air is next sent at a main cooling coil to identify the leaving air temperature.

Thereafter the air passed the second-step evaporator is identified as the second leaving air temperature. The third leaving air temperature is following the second-step condenser. And finally, the leaving air temperature is identified at the final unit.

Figure 4:
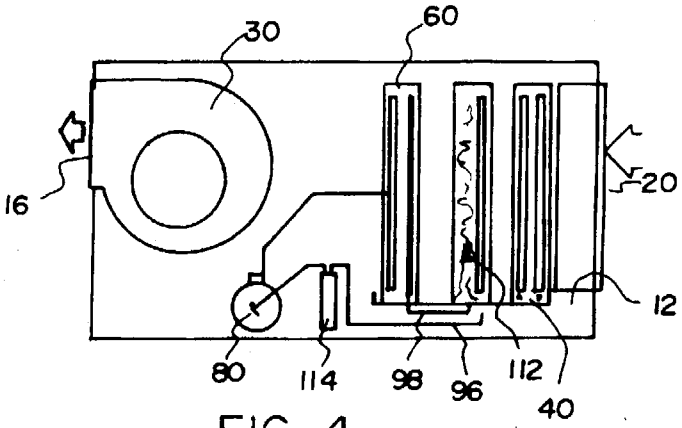
FIGS. 4 and 4A are a side schematic illustration of the air conditioning system of FIG. 1 along with a psychrometric diagram of the cooling associated therewith.
Figure 4A:
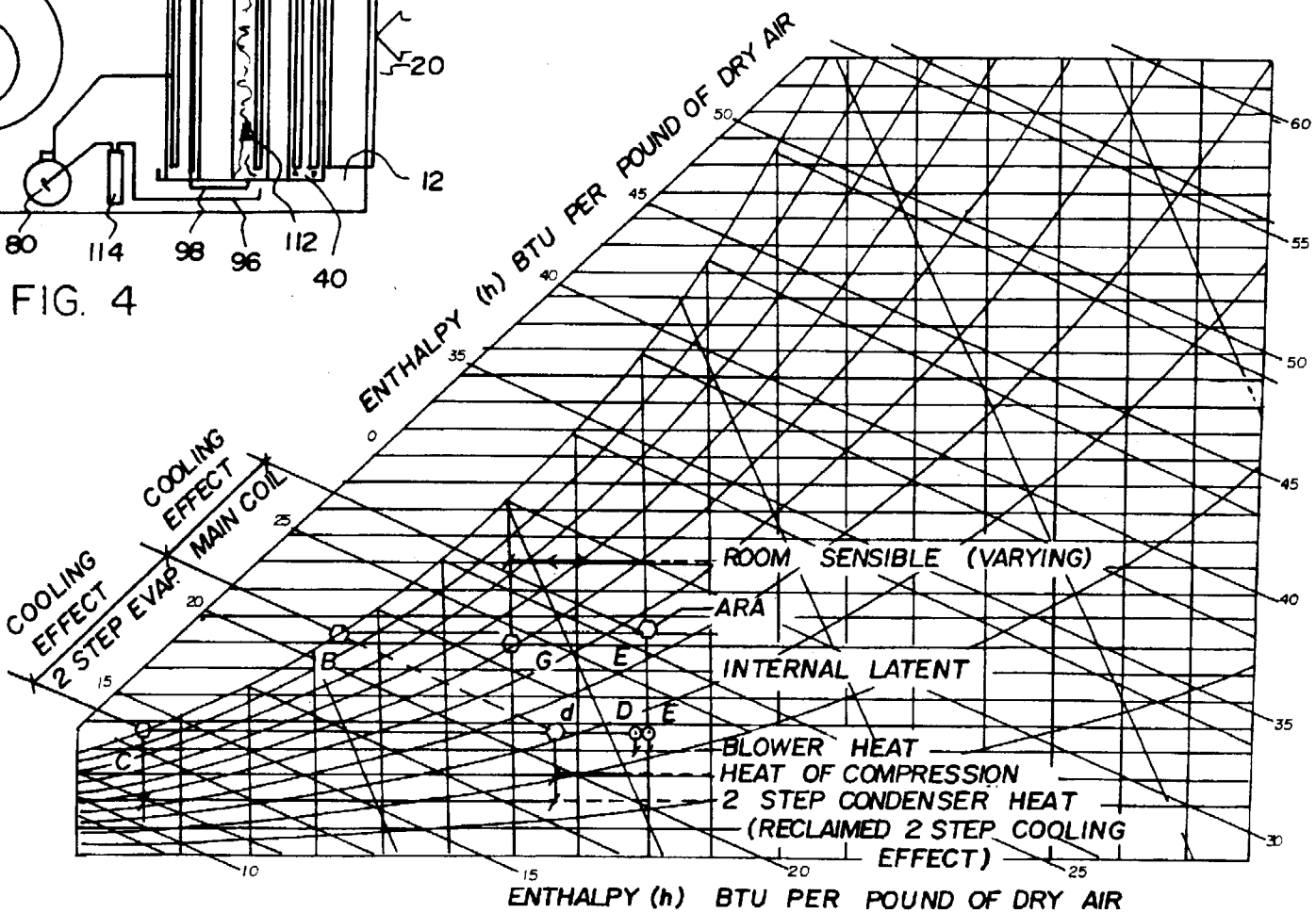
Figures 5, 5A:
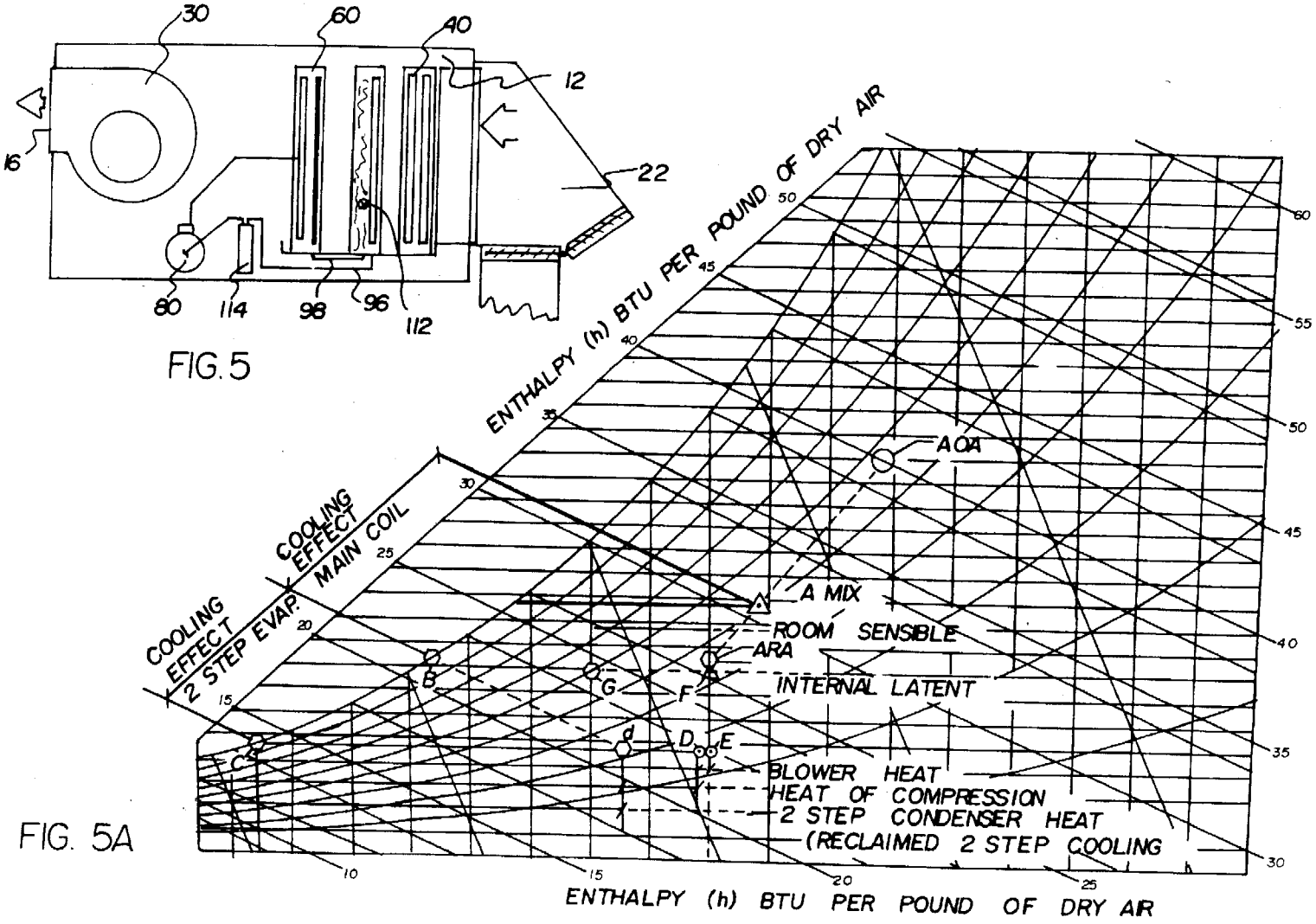
FIGS. 5 and 5A as well as 6 and 6A are alternate embodiments of the invention illustrating side elevational views and the psychrometric charts thereof.
Figures 6, 6A:
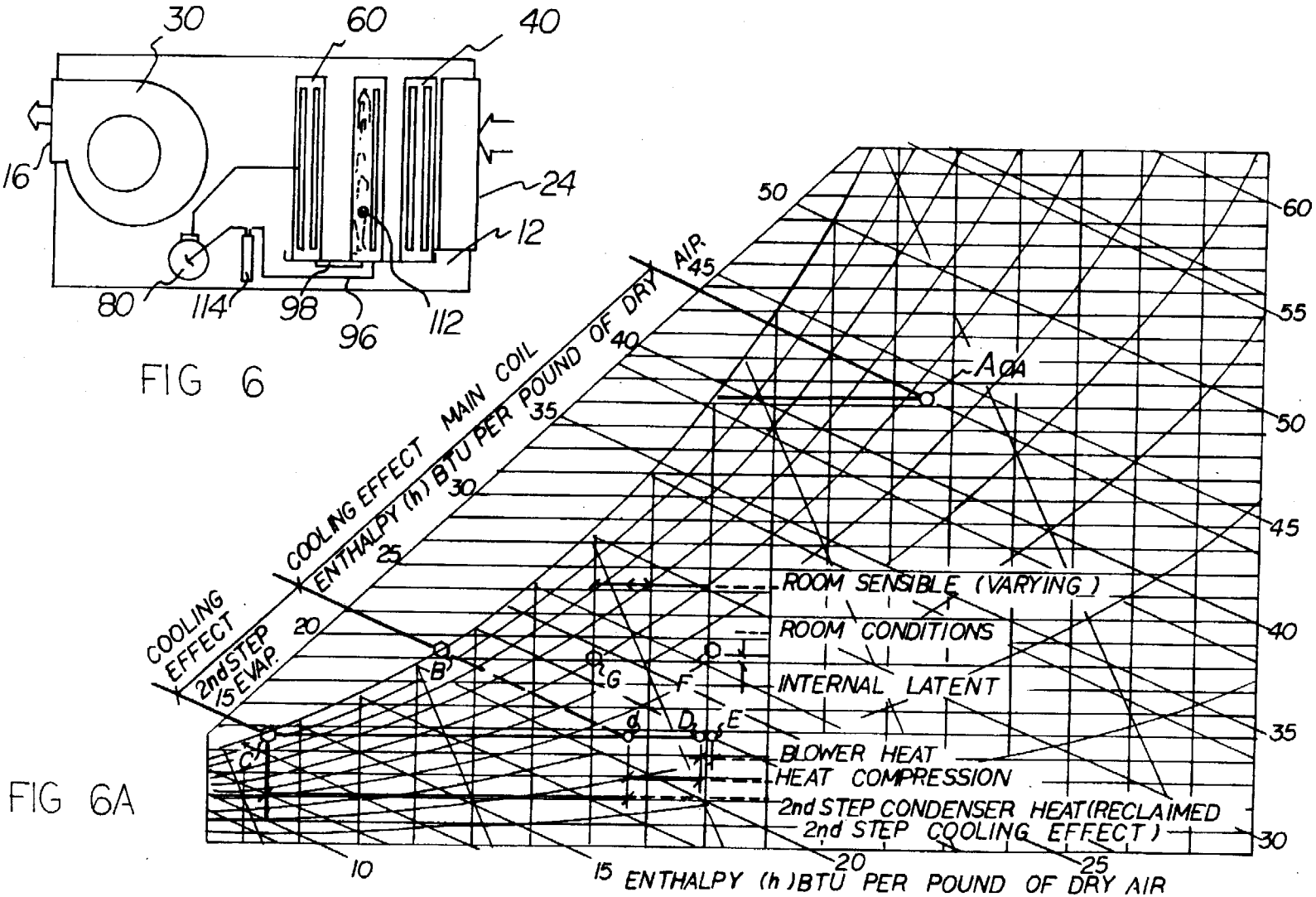

The embodiments of the present invention are shown in FIGS. 4, 5 and 6. An embodiment where the input air is only recycled room air is shown in FIGS. 4 and 4A. An embodiment where the input air is a combination of outside air and recycled room air is shown in FIGS. 5 and 5A. Finally, an embodiment where only outside air is employed is shown in FIGS. 6 and 6A.

In the psychrometric chart as shown in FIGS. 4A, 5A and 6A, the six-sided figures relate to a full system air flow, the circled points refer to a two-step dehumidifying air flow while the points in the triangle relate to a two-flow mixture point. The key points on the chart are the room sensible temperature which is varying, the inside air temperature (ARA), the main cooling coil temperature (B), the second-step evaporator temperature (C), the internal latent, the blower heat, the heat of compression and the second-step condenser heat (D), which is the reclaimed second-step cooling effect and the final unit temperature (E).

Additionally, with respect to FIGS. 4 and 4A, wherein input air is only recycled air, the points on the chart are essentially as previously as previously described except the room sensible varying temperature is noted, the inside air temperature (ARA) is noted, the latent internal energy is noted, the blower heat is noted, the heat of compression is noted, and the second-step condenser heat reclaiming the second cooling effect is noted.

As shown in FIGS. 5 and 5A, wherein the input air is a combination of outside air and recycled room air, the points on the chart are essentially as previously described, except the room sensible is noted, the inside air temperature (ARA) is noted and the outside air temperature (AOA) is noted.

In the final embodiment, referring to FIGS. 6 and 6A wherein the input air comprises only outside air, the same points are essentially marked as above. All outside air temperature (AOA) is identified and the following are noted; the room sensible variable, the room conditions, the internal latent energy, the blower heat, the heat of compression and the second-step condenser heating (which is the reclaimed second cooling effect).

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described.

What is claimed is:

1. Apparatus to condition air fed to a space from a first stream and a second stream by lowering the temperature and by reducing the moisture content within the second stream comprising:

a first conduit for the first stream for feeding air to the space, the first conduit having a primary air condition therein;

a second conduit for the second steam, the second conduit having an input end for receiving air to be conditioned and an output end for dispensing condition air into the space;

blower means to effect a flow of air to be conditioned from the input end to the output end of the second conduit;

a cooling member within the second conduit adjacent to the input end adapted to initially cool, to a major extent, the air flowing therepast to a temperature near saturation, the cooling member having, in association therewith, pipes adapted to circulate a first fluid coolant in a path which includes the cooling member whereat thermal energy is added to the first fluid coolant; and a separate system consisting of a separate condenser within the second conduit adjacent to the output end and adapted to reheat the air flowing therepast, such air having a lower dew point, a separate evaporator within the second conduit between and spaced from the cooling member and the separate condenser adapted to further cool to a further extent the air flowing therepast to the lower dew point for temperature reduction and moisture content reduction, a separate compressor, and separate piping coupling the separate evaporator, separate condenser and separate compressor in a closed second loop, independent of the closed first loop, for circulating a second fluid coolant between a separate evaporator whereat thermal energy is added to the second fluid coolant, (b) the separate condenser whereat thermal energy is removed from the second fluid coolant, and (c) the separate compressor whereat the fluid coolant is compressed.

2. A method for conditioning air fed to a space from a first stream and a second stream by lowering the temperature and by reducing the moisture within the second stream content comprising the steps of:

providing the second stream having a conduit having an input end for receiving air to be conditioned and an output end for dispensing condition air into a primary flow of conditioned air;

providing blower means to effect a flow of air to be conditioned from the input end to the output end of the conduit;

providing a cooling member within the conduit adjacent to the input end adapted to initially cool to a major extent the air flowing therepast to a temperature near saturation, the cooling member having, in association therewith, pipes in a closed first loop with means for circulating a first cooling fluid between the cooling member whereat thermal energy is added to the first cooling fluid and a remote location whereat thermal energy is removed from the first cooling fluid; and providing a separate system consisting of a separate condenser within the conduit adjacent to the output end adapted to reheat the air flowing therepast, a separate evaporator within the conduit between and spaced from the cooling member and the separate condenser adapted to further cool to a further extent the air flowing therepast to the lower dew point at between about 37 and 46 degrees Fahrenheit for temperature reduction and moisture content reduction, a separate compressor, and separate piping coupling the separate evaporator, separate condenser and separate compressor in a closed second loop, independent of the closed first loop, for circulating a second cooling fluid between the separate evaporator whereat thermal energy is added to the second cooling fluid, (b) the separate condenser whereat thermal energy is removed from the second cooling fluid, and (c) the separate compressor whereat the cooling fluid is compressed.

* * * * *